US010513756B2

(12) United States Patent
Kikutake et al.

(10) Patent No.: US 10,513,756 B2
(45) Date of Patent: Dec. 24, 2019

(54) NICKEL-BASED ALLOY

(71) Applicant: Nippon Yakin Kogyo Co., Ltd., Tokyo (JP)

(72) Inventors: Takafumi Kikutake, Kawasaki (JP); Fugao Wei, Kawasaki (JP)

(73) Assignee: NIPPON YAKIN KOGYO CO., LTD., Tokyo (JP)

( * ) Notice: Subject to any disclaimer, the term of this patent is extended or adjusted under 35 U.S.C. 154(b) by 0 days.

(21) Appl. No.: 16/114,432

(22) Filed: Aug. 28, 2018

(65) Prior Publication Data

US 2019/0078178 A1 Mar. 14, 2019

(30) Foreign Application Priority Data

Sep. 14, 2017 (JP) ..... 2017-176760

(51) Int. Cl.
*C22C 19/05* (2006.01)
*C22F 1/10* (2006.01)

(52) U.S. Cl.
CPC ..... *C22C 19/055* (2013.01); *C22C 19/056* (2013.01); *C22F 1/10* (2013.01)

(58) Field of Classification Search
CPC ..... C22C 19/055; C22C 19/056; C22F 1/10
See application file for complete search history.

(56) References Cited

U.S. PATENT DOCUMENTS 5,556,594 A * 9/1996 Frank ..... C22C 19/055 148/410
2011/0061394 A1* 3/2011 Hawk ..... C22C 19/055 60/752

FOREIGN PATENT DOCUMENTS

| | | | |
|---|---|---|---|
| JP | S57-9861 | A | 1/1982 |
| JP | H05-140707 | A | 6/1993 |
| JP | H05-255787 | A | 10/1993 |
| JP | H07-011404 | A | 1/1995 |
| JP | 2015-183290 | A | 10/2015 |

* cited by examiner

*Primary Examiner* — Jessee R Roe
(74) *Attorney, Agent, or Firm* — Oliff PLC

(57) ABSTRACT

The Ni-based alloy exhibits superior grain boundary corrosion resistance including C: 0.005 to 0.03 mass %, Si: 0.02 to 1 mass %, Mn: 0.02 to 1 mass %, P: not more than 0.03 mass %, S: not more than 0.005 mass %, Cr: 18 to 24 mass %, Mo: 8 to 10 mass %, Nb: 2.5 to 5.0 mass %, Al: 0.05 to 0.4 mass %, Ti: not more than 1 mass %, Fe: not more than 5 mass %, N: not more than 0.02 mass %, and Ni as a remainder and inevitable impurities. The C concentration range, the ratio of (Nb, Ti) C carbides to all carbides is not less than 90%, and the number of (Nb, Ti) C carbides satisfies the following formula: $-30\times T+37220=<$number of (Nb, Ti) C carbides (number/mm$^2$)$=<-7.7\times T^2+15700\times T-7866000$ under a condition of $2000\times\%\ C+890=<T$(temperature ° C.)$=<1150$.

10 Claims, 1 Drawing Sheet

NICKEL-BASED ALLOY

TECHNICAL FIELD

The present invention relates a nickel-based alloy used for various purposes such as in chemical plants, natural gas pipes, and containers.

BACKGROUND ART

Ni-based alloys, in particular Ni—Cr—Mo—Nb alloys, are used in harsh environments that are highly corrosive because such alloys have superior corrosion resistance. In this way, these alloys are used in harsh environments in which there is the risk that Fe-based alloys will be corroded. Therefore, corrosion resistance at surfaces is particularly important.

In order to apply corrosion resistance of Ni—Cr—Mo—Nb alloy sufficiently, techniques concerning formation of passivation films are known (for example, see Japanese Unexamined Patent Application Publication No. 2015-183290). Since corrosion resistance is exhibited at the surface, and surface conditions are particularly important. If the surface is viewed microscopically, the surface is seen to be constructed of crystal grains. The surfaces of the crystal grains are sufficiently maintained by a dense passivation film. However, there is a problem in that the crystal grain boundary has less corrosion resistance. The reason is that in Ni—Cr—Mo—Nb alloys, deposits containing Cr or Mo may be formed at grain boundaries if conditions of heat treatment are not appropriate. Since the passivation film mainly containing Ni, Cr, Mo and O, which is effective for corrosion resistance, is difficult to be formed densely on the deposits, corrosion resistance may be deteriorated. Corrosion resistance may be further deteriorated by sensitization. That is, in a neighborhood of the deposits containing Cr or Mo, the Cr or Mo in the base material is dispersed to the deposits, and an absentee layer containing less of these elements is formed. Since Cr and Mo are effective for corrosion resistance, if the passivation film dissolves in a corrosive environment, corrosion occurs from this absentee layer of Cr and Mo, and thus, corrosion resistance is extremely deteriorated.

In view of the above object, a technique in which Ni-based alloy having no carbide is produced by performing solution heat treatment is disclosed (for example, see Japanese Unexamined Patent Application Publication No. Showa 57 (1982)-9861). Actually, according to this technique, the alloy has superior corrosion resistance at a step of shipment from the factory. However, since Ni-based alloy is used being processed as a pipeline, chemical plant, reaction vessel or the like, there may be a case in which the alloy is heat treated via these processings or weldings. In that case, if an inappropriate heat treatment is performed, there may be a case in which deposits containing Cr or Mo are formed at grain boundaries. Then, grain boundary corrosion resistance is deteriorated by the abovementioned mechanism, grain boundary corrosion is promoted, and in the worst case, a serious problem occurs to the extent that corrosion penetrates the material. In this way, it can be said to be a very important technique to prevent carbides containing Cr or Mo, which is effective element for corrosion resistance, from forming at grain boundaries.

A technique in which formation of carbides containing Cr and Mo is prevented in Ni—Cr—Mo—Nb alloy containing 11 to 20% of Mo is known (for example, see Japanese Unexamined Patent Application Publication No. Heisei 7 (1995)-11404). That is, this is a technique to prevent carbides containing Cr and Mo from forming by depositing NbC at grain boundaries by performing aging heat treatment at 600 to 800° C. for 1 to 200 hours. However, it requires aging heat treatment at 600 to 800° C. and a long time of 1 to 200 hours, and there is a problem in that it is not actually possible to perform the treatment after the pipeline, chemical plant, reaction vessel or the like is completed. That is, the technique is a method that is impossible to employ industrially. In addition, the publication describes nothing about size and density of NbC, and it is not clear whether or not NbC is stabilized by this technique.

A Ni-based alloy exhibiting superior grain boundary breaking resistance is proposed, which is developed by producing test pieces under conditions not depositing NbC, that is, solution heat treatment, and by evaluating with grain boundary corrosion resistance test while imparting stress (for example, see Japanese Unexamined Patent Application Publication No. Heisei 5 (1993)-255787). As mentioned above, in a condition in which carbides are in a solid solution, inappropriate heat treatment after assembling pipelines, chemical plants, reaction vessels or the like may cause formation of deposits containing Cr or Mo at grain boundaries, and thus, the technique is not practical.

Furthermore, a technique in which solution heat treatment is performed at 1000 to 1100° C. and rapid cooling is performed at not less than 200° C./sec so as to solid-solve carbide (for example, see Japanese Unexamined Patent Application Publication No. Heisei 5 (1993)-140707). Corrosion resistance can be reliably obtained if these conditions can be realized. However, it is not possible to actually perform the heat treatment and rapid cooling after the pipeline, chemical plant, reaction vessel or the like is completed, and thus, the technique is not practical.

SUMMARY OF THE INVENTION

In view of the abovementioned conventional techniques, an object of the present invention is to make clear what effects the amount of C imparts on deposition behavior of carbides in order to control deposition containing Cr or Mo in Ni-based alloys and to provide a Ni-based alloy exhibiting superior grain boundary corrosion resistance.

The inventors performed research in order to solve the above problems. They evaluated products that were actually produced by using real equipment. That is, a slab produced by a continuous casting apparatus was hot rolled to obtain a hot rolled plate having a thickness of 6 mm, and the plate was cold rolled to produce a cold rolled plate having a thickness of 4 mm A test piece having a size of 20×25 mm was taken from the cold rolled plate. The present invention was completed according to a correlative relationship of NbC ratio, M6C (M is mainly Mo, Ni, Cr, or Si) ratio, M23C6 (M is mainly Cr, Mo, or Fe) ratio, NbC density and size factor and results of a grain boundary corrosion resistance test. That is, they found that grain boundary corrosion resistance can be highly maintained by restraining deposition of M6C and M23C6 and by effectively depositing NbC. This invention enables more accurate control by revealing a quantitative relationship of C concentration and temperature by analyzing an equilibrium diagram of a multicomponent type alloy of Ni—Cr—Mo—Nb base alloy in detail.

In particular, in the alloy, not only is the addition effect of Nb extremely important in increasing strength, but Nb is also extremely important for preventing sensitization conditions which deteriorate grain boundary corrosion resistance. The reason is that C combines with Nb in order to keep Cr and Mo (these are important elements to keep grain boundary corrosion resistance in a good condition) in a solid solution condition, and NbC is formed. The present invention was developed based on the above knowledge.

That is, the Ni-based alloy of the present invention includes C: 0.005 to 0.03 mass %, Si: 0.02 to 1 mass %, Mn: 0.02 to 1 mass %, P: not more than 0.03 mass %, S: not more than 0.005 mass %, Cr: 18 to 24 mass %, Mo: 8 to 10 mass %, Nb: 2.5 to 5.0 mass %, Al: 0.05 to 0.4 mass %, Ti: not more than 1 mass %, Fe: not more than 5 mass %, N: not more than 0.02 mass %, with Ni as the remainder and inevitable impurities, wherein within the C concentration range, the ratio of (Nb, Ti) C carbides to all carbides is not less than 90%, and the number of (Nb, Ti) C carbides satisfy following formula:

$$-30\times T+37220=<\text{number of (Nb,Ti)C carbides (number/mm}^2)=<-7.7\times T^2+15700\times T-7866000 \text{ under a condition of } 2000\times\%\ C+890=<T(\text{temperature } ^\circ C.)=<1150.$$

It is desirable that PRE value=Cr %+3.3Mo %+16N % is not less than 50 and the size of the (Nb, Ti) C carbides be in a range of 0.03 to 3 μm in the Ni-based alloy of the present invention.

It is desirable that corrosion rate in ASTM G28 Method A test be less than 1.5 mm/y in the Ni-based alloy of the present invention.

It is desirable that corrosion rate in ASTM G28 Method A test after heat treatment at 500 to 800° C. for 1 to 20 h be less than 1.5 mm/y in the Ni-based alloy of the present invention.

It is desirable that precipitation of carbides containing more than 50% of Mo or Cr is suppressed to less than 10% of all carbides, by dispersing the (Nb, Ti) C carbides in hot rolling at temperatures of $10^4\times$C %+950 to 2000×% C+890° C. in the Ni-based alloy of the present invention.

Furthermore, the Ni-based alloy of the present invention includes C: 0.005 to 0.03 mass %, Si: 0.02 to 1 mass %, Mn: 0.02 to 1 mass %, P: not more than 0.03 mass %, S: not more than 0.005 mass %, Cr: 18 to 24 mass %, Mo: 8 to 10 mass %, Nb: 2.5 to 5.0 mass %, Al: 0.05 to 0.4 mass %, Ti: not more than 1 mass %, Fe: not more than 5 mass %, N: not more than 0.02 mass %, with Ni as the remainder and inevitable impurities, wherein within the C concentration range, the ratio of (Nb, Ti) C carbides to all carbides is not less than 90%, and the number of (Nb, Ti) C carbides is 6000 to 100000 (number/mm$^2$).

It is desirable that N: 0.002 to 0.02 mass % in the Ni-based alloy of the present invention.

It is desirable that the size of the (Nb, Ti) C carbides be 0.03 to 3 μm in the Ni-based alloy of the present invention.

It is desirable that corrosion rate in ASTM G28 Method A test be less than 1.5 mm/y in the Ni-based alloy of the present invention.

It is desirable that corrosion rate in ASTM G28 Method A test after heat treatment at 500 to 800° C. for 1 to 20 h be less than 1.5 mm/y in the Ni-based alloy of the present invention.

Deposition of carbides of Cr or Mo can be restrained by forming (Nb, Ti) C carbides. Since grain boundary corrosion resistance can be maintained in an appropriate condition by that, grain boundary corrosion resistance is prevented from deteriorating even by the heat treatment performed at an actual site after shipment of the alloy, and thus, a material for use in extremely severe environments can be provided.

BEST MODE FOR CARRYING OUT THE INVENTION

Figure 1:
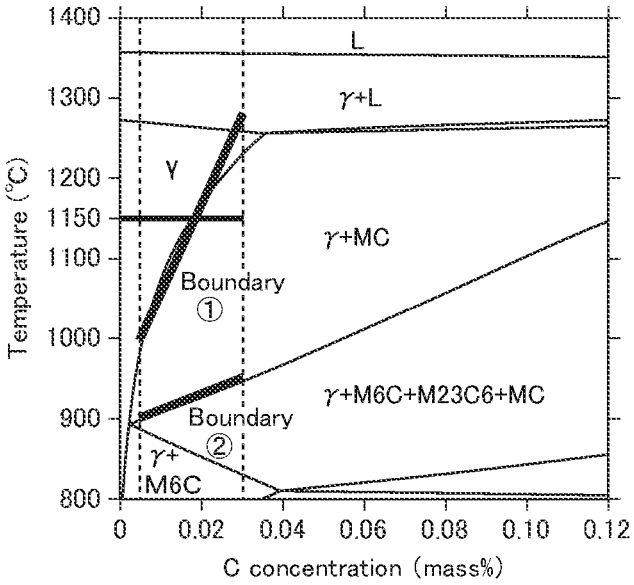
FIG. 1 is a graph showing an equilibrium diagram in the Ni-based alloy of the present invention, and showing a relationship between temperature and carbon content (mass %).
Figure 2:
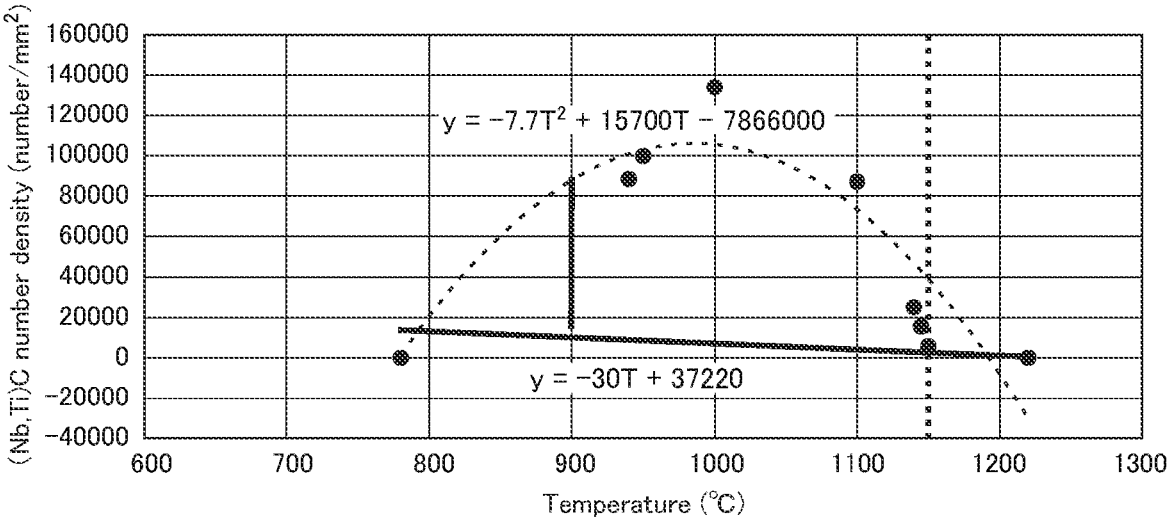
FIG. 2 is a graph showing a relationship between the number of (Nb, Ti) C carbides (number/mm$^2$) and heat treatment temperature.

Hereinafter, reasons for limitations of composition ranges of the present invention are explained. It should be noted that all "%" means "mass %".

C: 0.005 to 0.03%

C is an effective element for maintaining strength of an alloy. Therefore, at least 0.005% is necessary. However, this combines Cr or Mo and deposits carbides in a heat influenced part or the like in a heat treatment process or welding. Since Cr and Mo are effective elements for maintaining corrosion resistance, an absentee layer is generated around deposits, and grain boundary corrosion resistance is deteriorated. Therefore, C is specified as not more than 0.03%. Therefore, C is specified in the range of 0.005 to 0.03%. The content is desirably 0.007 to 0.028%, more desirably 0.01 to 0.02%, and further more desirably 0.011 to 0.018%.

Si: 0.02 to 1%

Si is an effective element for deoxidation, and at least 0.02% is necessary. However, since it also promotes formation of M6C and M23C6 and deteriorates grain boundary corrosion resistance, Si should be reduced to not more than 1%. Therefore, Si is specified in the range of 0.02 to 1%.

Mn: 0.02 to 1%

Mn is an effective element for deoxidation, and at least 0.02% is necessary. However, since it easily promotes formation of MnS and deteriorates pitting corrosion resistance at over 1%, Mn is specified in the range of 0.02 to 1%.

P: not more than 0.03%

Since P is a harmful element for hot workability, and it should be removed as much as possible. Therefore, P is specified at not more than 0.03%.

S: not more than 0.005%

Since S is also a harmful element for hot workability as is P, it should be removed as much as possible. Therefore, S is specified at not more than 0.005%.

Cr: 18 to 24%

Cr is an important element to form a passivation film and maintain corrosion resistance. Therefore, it is necessary that a base material contain Cr at not less than 18%. However, excess content causes M23C6 (M is mainly Cr, Mo, and Fe) to deposit easily. Since this tendency is noticeable and corrosion resistance is deteriorated if the content is more than 24%, Cr is specified in the range of 18 to 24%. The content is desirably 20 to 23% and is more desirably 21 to 22.8%.

Mo: 8 to 10%

Mo is an important element to form a passivation film and maintain corrosion resistance. Therefore, it is necessary that a base material contain Mo at not less than 8%. However, excess content causes M6C (M is mainly Mo, Ni, Cr, and Si) to deposit easily and strength is increased, thereby worsening workability, and the content is specified in the range of 8 to 10%. The content is desirably 8.1 to 9.0% and is more desirably 8.2 to 8.7%.

Nb: 2.5 to 5.0%

Nb is an element improving strength. Furthermore, since it combines with carbon so as to form NbC, it exhibits important effects in which Mo and Cr are prevented from combining with carbon. Therefore, it also has a function to increase grain boundary corrosion resistance. However, a temperature at which ductility is exhibited is reduced and hot processing is impossible if not less than 5% is contained. Therefore, the content is specified in the range of 2.5 to 5.0%. The content is desirably 3 to 4.8% and is more desirably 3.5 to 4.5%.

Al: 0.05 to 0.4%

Al is an important element for deoxidation and desulfuration. At least 0.05% is necessary in order to perform deoxidation and desulfuration and satisfy a S content of the present invention of not more than 0.005%. However, there is a risk of formation of alumina clusters if more than 0.4% is added. Therefore, the content is specified in the range of 0.05 to 0.4%. The content is desirably 0.1 to 0.35% and more desirably 0.15 to 0.33%.

Ti: Not more than 1%

Ti is an effective element to improve strength. Furthermore, Ti combines with carbon so as to form TiC in a manner similar to Nb, and it prevents Cr and Mo from forming carbides. Therefore, it also has a function to increase grain boundary corrosion resistance, and the content is specified not more than 1%.

Fe: Not more than 5%

Fe is often added to reduce production cost; however, the content is set to be not more than 5% since high Fe concentration in a passivation film may result in decrease of corrosion resistance. The content is desirably not more than 4.8% and is more desirably not more than 4.7%.

N: Not more than 0.02%

N should be reduced as much as possible because it forms TiN which clusters and causes surface defects. Therefore, the content is specified as being not more than 0.02%. On the other hand, addition of a minimum amount is desirable in order to exhibit strength and corrosion resistance, and it is desirable to add not less than 0.002%. The content is more desirably 0.002 to 0.015%. It should be noted that N concentration was accurately controlled by nitrogen gas uptake or addition of ferrochrome nitride during AOD or VOD.

Basically, the alloy of the present invention is a Ni-based alloy. The reason is as follows. Since Ni is a noble metal, corrosion thereof is superior to that of Fe. Since unlike a case in which Fe generates hydroxide $Fe(OH)_2$, Ni does not generate hydroxide in a passivation film, the passivation film is dense and has high protecting effect. In addition, since the amount of an alloy element which can solid-solve is greater in a Ni-based alloy than in an Fe based alloy, the Ni-based alloy can contain more of an element that increases corrosion resistance such as Cr or Mo. Therefore, in order to form a protecting film having superior corrosion resistance on a surface of a base material, a Ni-based alloy must be chosen. In addition, an inevitable impurity in the present invention is Cu, Co, W, Ta, V, B and H.

The reason that the ratio of (Nb, Ti)C carbides to all carbides must be not less than 90% in the above C concentration range (C: 0.005 to 0.03%) is explained. This is because a degree of corrosion of less than 1.5 mm/y in the ASTM G28 Method A test cannot be achieved unless the ratio of deposition of M6C and M23C6 is reduced to less than 10%.

The basis for the number of (Nb, Ti) C carbides satisfying the formula:

$$-30\times T+37220=<\text{number of (Nb,Ti)C carbides (number/mm}^2)=<-7.7\times T^2+15700\times T-7866000$$

under a condition of 2000×% C+890° C.=<T(temperature ° C.)=<1150 was experimentally verified and it was concluded from consistency with the equilibrium diagram. If the condition is satisfied, the ratio of (Nb, Ti)C carbides becomes not less than 90% and the corrosion degree less than 1.5 mm/y can be achieved in the ASTM G28 Method A test. Furthermore, in a range of temperature 30° C. higher than a boundary of $10^4$×C %+950, since M6C and M23C6 is solid-solved and NbC partially remained, a corrosion degree of less than 1.5 mm/y could be achieved in the ASTM G28 Method A test after stress releasing annealing.

It is very important to measure a number distribution of the abovementioned (Nb, Ti)C carbides accurately. It is necessary that after heat treatment is performed at the temperature, first, cooling be rapidly performed, and a condition at the temperature be maintained. Therefore, cooling is performed at not less than 50° C./sec. A cold-rolled plate having a thickness of 4 mm produced as mentioned above was cut to a size of 10×10 mm Wet polishing was performed on a cross section perpendicular to a rolled direction, and furthermore, electrolytic polishing was performed, and the polished surface was observed by a FE-SEM so as to measure the number distribution. Composition of the carbides was identified by quantitative analysis.

The reason that PRE value=Cr %+3.3Mo %+16N % need not be less than 50 is explained. In order to form a dense passivation film on the surface, the PRE is defined as being not less than 50. It should be noted that although this is not particularly limited, it is desirable to let stand for four days in air or that a passivation treatment be performed in order to obtain a dense passivation film.

The reason that size of the (Nb, Ti) C carbides must be in a range of 0.03 to 3 μm is explained. If it is dispersed finer than 0.03 μm, crystal grains may be finer by a pinning effect, and cold workability may be deteriorated. On the other hand, if it is larger than 3 μm, since a dense passivation film is not formed in the deposition, this location may be an origin of corrosion, and there is a risk of crevice corrosion occurring. Therefore, the range is specified in the range of 0.03 to 3 μm. The range is more desirably 0.1 to 2 μm.

By satisfying the range of the invention, the corrosion degree can be less than 1.5 mm/y in the ASTM G28 Method A test. According to the circumstances, in order to release stress which was induced during processing and welding, there is a case in which the alloy is heat treated at 500 to 800° C. for 1 to 20 hours. By satisfying the range of the invention, the corrosion degree can be less than 1.5 mm/y in the ASTM G28 Method A test. It is desirably less than 1.3 mm/y, more desirably 1.2 mm/y, and further more desirably less than 1 mm/y.

If hot rolling is performed at a temperature $10^4$×C %+950 to 2000×C %+890° C., as mentioned above, since (Nb, Ti)C carbides can be more effectively deposited, temperature of the hot rolling is set in the range of $10^4$×C %+950 to 2000×C %+890° C.

EXAMPLES

Raw materials such as scraps, Ni, Cr, Mo and the like were melted in an electric furnace, and decarburization was performed by at least one of blowing oxygen in AOD (Argon Oxygen Decarburization) and VOD (Vacuum Oxygen Decarburization). Then, Cr reduction was performed by adding Al and lime, lime and fluorite were further added so as to form $CaO—SiO_2—Al_2O_3—MgO—F$ type slag on the molten alloy, and deoxidation and desulfuration were performed. $SiO_2$ concentration in the slag was controlled to be not more than 10%. The molten alloy refined in this way was cast by a continuous casting apparatus so as to obtain a slab.

After that, the slab was hot rolled by a Steckel Mill, and it was then cold rolled so as to obtain a cold rolled plate having a thickness of 4 mm. The chemical compositions of the alloys produced are shown in Table 1, and the measurement conditions and evaluation results are shown in Table 2. In Tables 1 and 2, a value in brackets is out of the range of the present invention. Hereinafter, the evaluation method is shown.

(1) Analysis was performed by fluorescent X-ray analysis. However, C and S were analyzed by a combustion weight method and O was analyzed by an inert gas impulse melting IR absorption method.

(2) Temperature of hot rolling was measured by a radiation thermometer after finish rolling by a Steckel Mill and before water cooling.

(3) Number distribution of (Nb, Ti)C: It is very important to accurately measure the number distribution of (Nb, Ti)C carbides. It was necessary that after heat treatment was performed at the temperature first, cooling was rapidly performed, and a condition of at the temperature was maintained. Therefore, cooling was performed at not less than 50° C./sec. A cold-rolled plate having a thickness of 4 mm produced as mentioned above was cut to a size of 10×10 mm Mirror polishing was performed on a cross section parallel to a rolled direction, and the polished surface was observed by a FE-SEM so as to measure the number distribution. It should be noted that an area measured was 1 $mm^2$.

(4) Composition of the carbides was identified by quantitative analysis by using EDS.

(5) Size of (Nb, Ti)C was measured by FE-SEM as mentioned above. It should be noted that a size shown in Table 2 is an average value representing measured values.

(6) Evaluation of grain boundary corrosion resistance: an annual corrosion depth (mm/y) was evaluated by the ASTM G28 Method A test.

(7) SR means stress release annealing, and heat treatment at 600° C. for 5 hours was performed. This heat treatment replicates a heat treatment that is performed at the customer end after shipment of an alloy and is a cause of deterioration of grain boundary corrosion resistance.

TABLE 1

| | | Chemical composition (mass %) remainder Ni | | | | | | | | | | | |
|---|---|---|---|---|---|---|---|---|---|---|---|---|---|
| | No. | C | Si | Mn | P | S | Cr | Mo | Nb | Al | Ti | N | Fe |
| Examples | 1 | 0.006 | 0.25 | 0.25 | 0.014 | 0.0002 | 22.51 | 8.51 | 3.31 | 0.24 | 0.25 | 0.009 | 4.61 |
| | 2 | 0.012 | 0.23 | 0.18 | 0.016 | 0.0003 | 23.67 | 8.35 | 3.25 | 0.39 | 0 | 0.012 | 2.53 |
| | 3 | 0.018 | 0.22 | 0.85 | 0.015 | 0.0003 | 20.31 | 9.24 | 3.89 | 0.25 | 0.37 | 0.015 | 4.52 |
| | 4 | 0.008 | 0.15 | 0.38 | 0.019 | 0.0032 | 23.56 | 8.04 | 2.68 | 0.08 | 0.17 | 0.008 | 1.85 |
| | 5 | 0.019 | 0.42 | 0.45 | 0.011 | 0.0001 | 22.14 | 8.89 | 3.51 | 0.38 | 0.56 | 0.006 | 2.04 |
| | 6 | 0.017 | 0.07 | 0.23 | 0.022 | 0.0005 | 21.85 | 8.45 | 4.23 | 0.28 | 0.81 | 0.016 | 0.91 |
| | 7 | 0.013 | 0.18 | 0.42 | 0.019 | 0.0005 | 20.12 | 8.32 | 3.21 | 0.35 | 0.33 | 0.012 | 3.22 |
| Comparative | 8 | (0.004) | 0.25 | 0.29 | 0.018 | 0.0003 | (17.45) | 8.22 | 2.98 | 0.38 | 0.24 | (0.001) | 4.61 |
| Example | 9 | 0.012 | 0.61 | 0.41 | 0.02 | 0.0002 | 20.52 | 9.12 | 3.78 | 0.35 | 0.45 | 0.012 | 2.53 |
| | 10 | (0.032) | 0.03 | 0.41 | 0.022 | 0.0015 | 22.85 | (7.23) | 3.89 | 0.03 | 0.24 | 0.013 | 4.52 |
| | 11 | 0.005 | 0.24 | 0.32 | 0.019 | 0.0002 | 22.31 | 8.59 | 2.75 | 0.42 | 0.25 | (0.024) | 1.85 |
| | 12 | (0.003) | 0.24 | 0.33 | 0.018 | 0.0002 | 22.51 | 8.21 | 3.51 | 0.48 | 0.48 | 0.012 | 2.04 |
| | 13 | (0.024) | (1.45) | 0.45 | 0.017 | 0.0001 | 22.39 | (11.5) | 4.23 | 0.38 | 0.22 | 0.012 | 3.11 |
| | 14 | (0.001) | 0.24 | 0.35 | 0.018 | 0.0005 | 21.85 | 8.24 | 3.21 | 0.44 | 0.18 | 0.023 | 3.22 |

TABLE 2

| | | Hot rolling condition | | | | (Nb,Ti)C deposition condition | |
|---|---|---|---|---|---|---|---|
| | No. | Hot rolling temperature ° C. | Boundary ② 2000 × % C + 890 ° C. | Boundary ① 10^4 × % C + 950 ° C. | Heat treatment ° C. | −30 × T + 37220 number/$mm^2$ | −7.7 × T^2 + 15700 × T − 7866000 number/$mm^2$ |
| Examples | 1 | 920 | 902 | 1010 | 1140 | 3020 | 25080 |
| | 2 | 980 | 914 | 1070 | 1145 | 2870 | 15608 |
| | 3 | 940 | 926 | 1130 | 1150 | 2720 | 5750 |
| | 4 | 920 | 906 | 1030 | 950 | 8720 | 99750 |
| | 5 | 980 | 928 | 1140 | 940 | 9020 | 88280 |
| | 6 | 1060 | 924 | 1120 | 1100 | 4220 | 87000 |
| | 7 | 1030 | 916 | 1080 | 1000 | 7220 | 134000 |
| Comparative | 8 | (1060) | 898 | 990 | 1100 | 4220 | 87000 |
| Example | 9 | (1100) | 914 | 1070 | (1220) | 620 | — |
| | 10 | (920) | 954 | 1270 | 1100 | 4220 | 87000 |
| | 11 | (1070) | 900 | 1000 | (780) | 13820 | — |
| | 12 | (700) | 896 | 980 | (800) | 13220 | — |

TABLE 2-continued

| | | | | | | | |
|---|---|---|---|---|---|---|---|
| 13 | 1100 | 938 | 1190 | (900) | 10220 | 27000 |
| 14 | 910 | 892 | 960 | (750) | 14720 | — |

| | | Results | | | | Test I ASTM G28 | Test II ASTM G28 |
|---|---|---|---|---|---|---|---|
| | No. | (Nb,Ti)C ratio % | (Nb,Ti)C density number/ $mm^2$ | PRE value | (Nb,Ti)C size μm | Method A test result mm/y | Method A test after SR result mm/y |
| Examples | 1 | 98 | 22.000 | 50.7 | 0.1 | 0.45 | 1.23 |
| | 2 | 92 | 14.000 | 51.4 | 0.4 | 0.43 | 1.14 |
| | 3 | 97 | 6.800 | 51.0 | 0.9 | 0.51 | 1.44 |
| | 4 | 92 | 98.000 | 50.2 | 0.09 | 0.44 | 0.78 |
| | 5 | 94 | 80.000 | 51.6 | 0.5 | 0.48 | 0.69 |
| | 6 | 100 | 73.000 | 50.0 | 2.2 | 0.32 | 0.56 |
| | 7 | 98 | 61.000 | 47.8 | 0.8 | 0.39 | 0.67 |
| Comparative Example | 8 | 95 | (100) | 44.8 | 1.2 | 1.86 | 2.4 |
| | 9 | (0) | (0) | 50.8 | 5.4 | 1.67 | 2.3 |
| | 10 | (30) | (3.800) | 46.9 | 6.8 | 1.91 | 2.5 |
| | 11 | (5) | (0) | 51.0 | 0.02 | 1.76 | 2.1 |
| | 12 | (10) | (10) | 49.8 | 0.02 | 2.12 | 2.7 |
| | 13 | (3) | (20) | 60.5 | 0.01 | 1.82 | 3.56 |
| | 14 | (0) | (0) | 49.4 | — | 2.76 | 3.67 |

Effects of the present invention are clear by the Examples in Table 2. In addition, FIG. 1 shows an equilibrium diagram from the results of the research. In the equilibrium diagram in FIG. 1, $10^4$×C %+950 shown in the claim 5 is a boundary 1 and 2000×% C+890 is a boundary 2. In addition, in Table 2, the test I means the ASTM G28 Method A test, and the test II means the ASTM G28 Method A test after stress releasing.

The hot rolling temperature was between the boundaries 1 and 2 shown in FIG. 1 in a case of Nos. 1 to 3 which are the inventive examples, and (Nb, Ti)C was deposited in the range; however, since annealing temperature is in a range between the boundary 1 and 1150° C., the result of test I satisfy less than 1.5 mm/y, which was good. Furthermore, the annealing temperature of Nos. 1 and 3 in heat treatment was within a temperature range 30° C. higher than the boundary (1). Therefore, although it is a range in which C is easily solid-solved, since (Nb, Ti)C remains, the result of the test II was also good. It should be noted that the value of the corrosion resistance was within the range of the invention; however, it was relatively high.

The hot rolling temperature was between the boundaries 1 and 2 and heat treatment thereafter was also appropriate in Nos. 4 to 7, and the results of the tests I and II were both good.

Since the amount of C was lower than the lower limit value of 0.005% in No. 8, strength was low. Furthermore, since Cr and N amounts were lower than the lower limitation values of 18% and 0.001% respectively, corrosion resistance was low and the PRE value was not more than 50. Furthermore, since hot rolling finishing temperature and annealing temperature were not less than the boundary 1 and not more than 1150° C., C was in a condition of a solid solution. Therefore, since M6C and M23C6 were solid-solved, although (Nb, Ti)C was 95%, the number was less, which was 100 number/$mm^2$. Therefore, the results were both above 1.5 mm/y in the tests I and II.

Since hot rolling finishing temperature and annealing temperature were not less than the boundary 1 and further annealing temperature was above 1150° C. in No. 9, (Nb, Ti)C was completely in solid solution condition and was not deposited. Therefore, the results were both above 1.5 mm/y in the tests I and II.

The amount of C was 0.032%, which is high, and a boundary 1 was 1270° C. and a boundary 2 was 954° C. in No. 10. Since hot rolling finishing temperature was 920° C., which is lower than the boundary 2, M6C was deposited after hot rolling. Since the annealing temperature was 1100° C., which was between the boundaries 1 and 2, (Nb, Ti)C was easily deposited. Therefore, the ratio of (Nb, Ti)C was about 30%, and the number of (Nb, Ti)C was 5,000 number/$mm^2$, which is small. As a result, the results were both above 1.5 mm/y in the tests I and II.

The amount of C was 0.005%, which is the lower limit value, a boundary 1 was 1000° C., and a boundary 2 was 900° C. in No. 11. Since hot rolling finishing temperature was 1070° C., which is higher than the boundary 1, the amount of C after hot rolling was in a solid solution condition. On the other hand, since the annealing temperature was 780° C., M6C and M23C6 were deposited. Therefore, the ratio of (Nb, Ti)C was 5%, and the number of (Nb, Ti)C was 200 number/$mm^2$, which is small. As a result, the results were both above 1.5 mm/y in the tests I and II. In addition, the N value was 0.024%, which is above the upper limit value, and TiN clusters were generated and nozzle blocking occurred in a continuous casting.

The amount of C was lower than 0.005% which is the lower limit value, strength was low, a boundary 1 was 980° C., and a boundary 2 was 896° C. in No. 12. Since hot rolling finishing temperature and annealing temperature were both lower than the boundary 2, M6C and M23C6 were deposited. The ratio of (Nb, Ti)C was 5%, and number of (Nb, Ti)C was 200 number/$mm^2$, which is small. Furthermore, PRE was also not more than 50, and as a result, the results were both above 1.5 mm/y in the tests I and II.

The amounts of C, Si, and Mo were higher than each upper limit value, and the composition easily gave rise to deposition of large amounts of M6C in No. 13. A boundary 1 was 1190° C., a boundary 2 was 938° C., hot rolling temperature was 1100° C. and annealing temperature was 900° C. MC was deposited after hot rolling and M6C and M23C6 were deposited after annealing. Since large amounts of M6C were deposited by the composition and annealing conditions, the ratio of (Nb, Ti)C was low, and the number of (Nb, Ti)C was 20 number/$mm^2$, which is small. As a result, the results were both above 1.5 mm/y in the tests I and II.

Since the amount of C was not more than the lower limit value, which was lowest in the Examples, strength was low in No. 14. A boundary 1 was 960° C., a boundary 2 was 892° C., hot rolling finishing temperature was not less than the boundary 2 within 30° C., and annealing temperature was not more than the boundary 2. (Nb, Ti)C was not deposited. As a result, the results were both above 1.5 mm/y in the tests I and II.

According to the promising present invention, Ni-based alloy having high grain boundary corrosion resistance can be produced, which can restrain deterioration of grain boundary corrosion resistance even by a heat treatment performed at an actual site after shipment of an alloy and which can be used for a long time in extremely severe grain boundary corrosion environments.

What is claimed is:

1. A Ni-based alloy comprising:
C: 0.005 to 0.03 mass %,
Si: 0.02 to 1 mass %,
Mn: 0.02 to 1 mass %,
P: not more than 0.03 mass %,
S: not more than 0.005 mass %,
Cr: 18 to 24 mass %,
Mo: 8 to 10 mass %,
Nb: 2.5 to 5.0 mass %,
Al: 0.05 to 0.4 mass %,
Ti: not more than 0.37 mass %,
Fe: not more than 5 mass %,
N: not more than 0.02 mass %,
Ni as a remainder, and
inevitable impurities,
wherein within the C concentration range, a ratio of (Nb, Ti) C carbides to all carbides is not less than 90%, and a number of the (Nb, Ti) C carbides satisfies following formula:

$$-30\times T+37220=<\text{number of (Nb,Ti)C carbides (number/mm}^2)=<-7.7\times T^2+15700\times T-7866000$$

under conditions of 2000×% C+890° C.=<T(temperature ° C.)=<1150.

2. The Ni-based alloy according to claim 1, wherein PRE value =Cr % +3.3Mo % +16N % is not less than 50 and a size of the (Nb, Ti) C carbides is in a range of 0.03 to 3 μm.

3. The Ni-based alloy according to claim 1, wherein a corrosion rate of the Ni-based alloy according to ASTM G28 Method A test is less than 1.5 mm/y.

4. The Ni-based alloy according to claim 1, wherein a corrosion rate of the Ni-based alloy according to ASTM G28 Method A test after heat treatment at a temperature in a range of from 500 to 800° C. for 1 to 20 h is less than 1.5 mm/y.

5. The Ni-based alloy according to claim 1, wherein precipitation of carbides containing more than 50% of Mo and Cr is suppressed to less than 10% of all carbides, by dispersing the (Nb, Ti) C carbides in hot rolling at temperatures of $10^4$× C %+950 to 2000× % C+890° C.

6. A Ni-based alloy comprising:
C: 0.005 to 0.03 mass %,
Si: 0.02 to 1 mass %,
Mn: 0.02 to 1 mass %,
P: not more than 0.03 mass %,
S: not more than 0.005 mass %,
Cr: 18 to 24 mass %,
Mo: 8 to 10 mass %,
Nb: 2.5 to 5.0 mass %,
Al: 0.05 to 0.4 mass %,
Ti: not more than 0.37 mass %,
Fe: not more than 5 mass %,
N: not more than 0.02 mass %,
Ni as a remainder, and
inevitable impurities,
wherein within the C concentration range, a ratio of (Nb, Ti) C carbides to all carbides is not less than 90%, and a number of the (Nb, Ti) C carbides is 6000 to 100000 (number/$mm^2$).

7. The Ni-based alloy according to claim 6, wherein N: 0.002 to 0.02mass %.

8. The Ni-based alloy according to claim 6, wherein a size of the (Nb, Ti) C carbides is 0.03 to 3 μm.

9. The Ni-based alloy according to claim 6, wherein a corrosion rate of the Ni-based alloy according to ASTM G28 Method A test is less than 1.5 mm/y.

10. The Ni-based alloy according to claim 6, wherein a corrosion rate of the Ni-based alloy according to ASTM G28 Method A test after heat treatment at a temperature in a range of from 500 to 800° C. for 1 to 20 his less than 1.5 mm/y.

* * * * *